US005638703A

United States Patent [19]

Callaway

[11] Patent Number: 5,638,703

[45] Date of Patent: Jun. 17, 1997

[54] GRASSCATCHER BAG FABRIC

[75] Inventor: Brian Callaway, Moore, S.C.

[73] Assignee: Milliken Research Corporation, Spartanburg, S.C.

[21] Appl. No.: 523,206

[22] Filed: Sep. 5, 1995

Related U.S. Application Data

[63] Continuation-in-part of Ser. No. 283,686, Aug. 1, 1994.

[51] Int. Cl.[6] ..... D04B 21/00

[52] U.S. Cl. ..... 66/195; 56/202

[58] Field of Search ..... 66/190, 192, 193, 66/195, 196, 170; 56/202

[56] References Cited

U.S. PATENT DOCUMENTS

| | | | |
|---|---|---|---|
| 1,513,066 | 10/1924 | Quick | 66/195 |
| 1,666,638 | 4/1928 | Bennett | 66/195 X |
| 4,279,134 | 7/1981 | Matsuda | 66/195 |
| 4,615,934 | 10/1986 | Ellison | 428/254 |
| 4,785,613 | 11/1988 | Rhode | 56/202 |

FOREIGN PATENT DOCUMENTS

| | | |
|---|---|---|
| 1242314 | 8/1960 | France . |
| 2151743 | 4/1972 | Germany . |

*Primary Examiner*—John J. Calvert
*Attorney, Agent, or Firm*—Terry T. Moyer; Earle R. Marden

[57] ABSTRACT

A 3-bar Raschel warp knit fabric for use in grasscatcher bags which has an additional high tenacity yarn knit in to provide a lower elongation yarn in the course direction to prevent the grasscatcher bag from dragging the ground as it is being filled. The fabric also has a second textured needle lap stitch yarn to provide cover and to prevent the exhaust of dust to the atmosphere from the interior of the bag.

15 Claims, 2 Drawing Sheets

GRASSCATCHER BAG FABRIC

This application is a continuation-in-part of application under 37 C.F.R. §1.62 of pending prior application Ser. No. 08/283,686, filed on Aug. 1, 1994, of Brian Callaway for IMPROVED GRASSCATCHER BAG FABRIC.

This invention relates to a knit fabric for use in grasscatcher bags which requires high tenacity or strength for impact but has reduced elongation so it does not drag the ground in use.

It is an object of the invention to provide a warp knit, high tenacity fabric for use in grasscatcher bags which has substantially lower elongation in the course or fill direction.

Other objects and advantages of the invention will become readily apparent as the specification proceeds to describe the invention with references to the accompanying drawings, in which.

Figure 2:
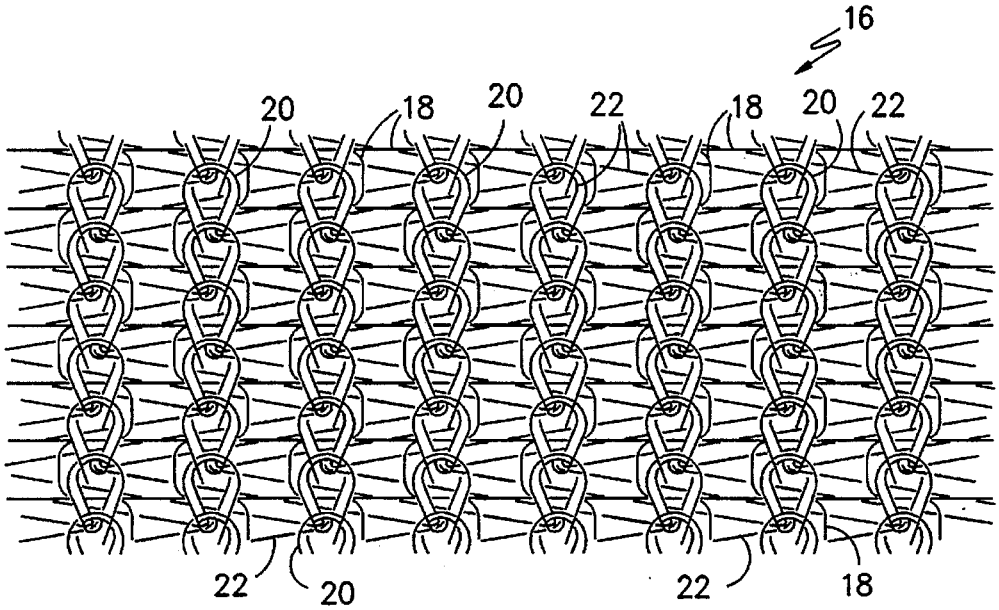
FIG. 2 is a blow-up view of the new and improved fabric.
Figures 3A, 3B, 3C:
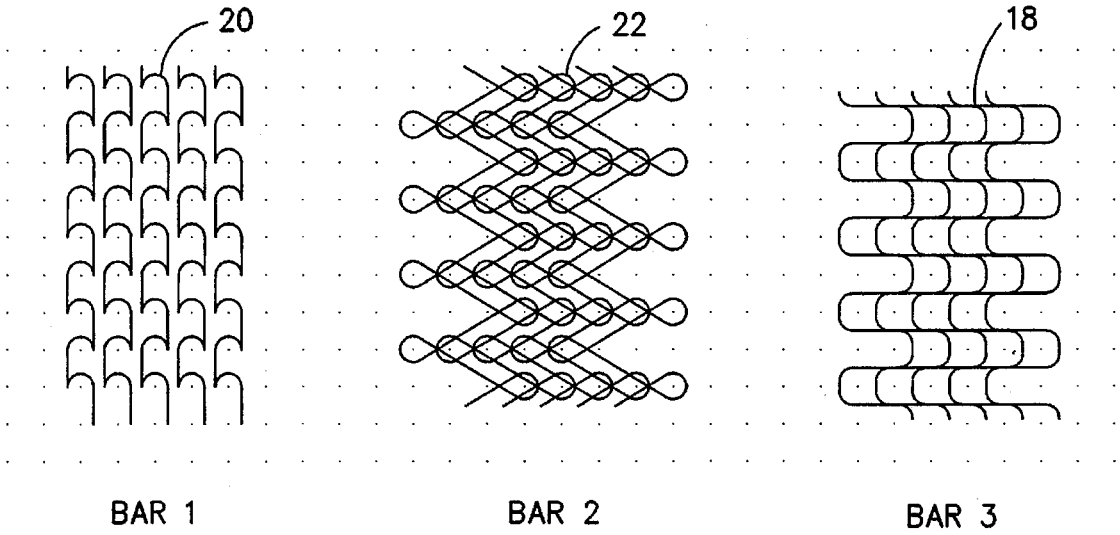

FIGS. 3A–C are point diagrams of the fabric shown in FIG. 2.

Figure 1:
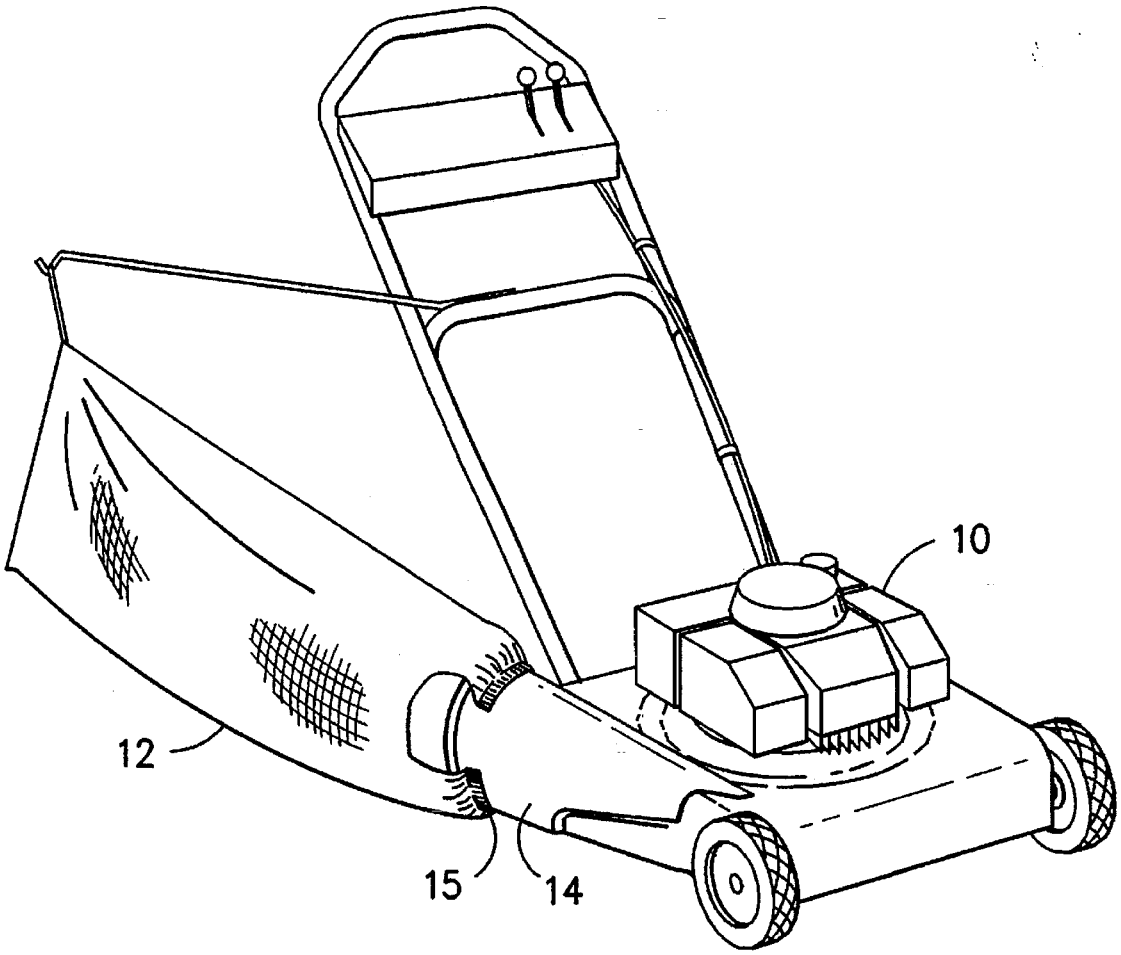
FIG. 1 is a perspective view of a lawn mower with a grasscatcher bag attached thereto which is made from the new and improved warp knit fabric.

Looking now to FIG. 1 there is shown a conventional lawn mower 10 with a grasscatcher bag 12 connected to the discharge chute 14 thereof. The lawn mower 10 is shown as a push style but obviously other mowers such as a riding mower could employ the bag 12 on the discharge thereof. The grasscatcher bag 12 has a suitable snap-on collar or band 15 around the course or fill direction of the fabric to engage the circumference of the discharge chute 14.

The standard grasscatcher bag is made from high tenacity yarn (840–1300 den.) in order to pass the performance requirements set by the Outdoor Power Equipment Institute but tends to elongate and stretch when subjected to lead as the bag fills up. The standard grass catcher bag shown in FIG. 1 typically is formed by forming a flat fabric into a tube shape and sewing the edges thereof together. The bag tends to sag and sometimes drags the ground. To prevent this condition the herein developed fabric has been developed.

The warp knit fabric 16 used in the construction of the bag 12 is a 3-bar Raschel warp knit fabric with the additional bar knitting in a lower elongation yarn in the course or fill direction. As shown in FIGS. 2 and 3, bar 3 which is knitting a high tenacity 150 denier polyester yarn 18 provides lower elongation in the course or fill direction while bars 1 and 2 knitting a drawn and textured polyester yarn 20 and 22, respectively, to maintain the required tensile strength in bag 12. Yarn 20 is a 1/150/34 drawn polyester yarn while yarn 22 is a 2/150/34 textured polyester yarn.

To provide the particular fabric 16 the yarn on bar 1 is knitting a 0-1, 1-0 pattern which is a conventional chain stitch, the yarn on bar 2 is knitting a 4-5, 1-0 pattern which is a conventional multiple needle lap stitch and the yarn on bar 3 is knitting 2-2, 0-0. It should be noted that each adjacent wale is connected to the next adjacent wale by the yarn 18 to inhibit elongation of the fabric in the course or fill direction without inhibiting the overall tensile strength of the fabric. In describing the fabric 16 the terms fill and course direction are used interchangeably while the term wale and warp direction are used interchangeably. By the terms fill or course direction it is meant the widthwise direction of the fabric as it is being knit and the warp or wale direction is the machine direction of the fabric.

In the preferred form of the invention the courses/inch is 21 and the wales/inch is 18 allowing the use of finer denier yarns without loss of strength or permeability. The increased density of the fabric permits the use of 150 denier polyester yarn while the texturing of the wale yarn 20 provides porosity for the passage of air but prevents the exhaust of dust therefrom. The use of 150 denier yarn, which is a common yarn, reduces the raw material cost of the finished grasscatcher bag fabric.

U.S. Pat. No. 4,785,613 discloses a grass catcher bag fabric similar to that disclosed herein. The herein disclosed fabric employs a closed textured needle lap stitch which substantially reduces the air permeability of the bag and lowers the elongation of the bag in the fill direction to prevent the bag from dragging the ground. To illustrate these advantages, the following table illustrates the superior performance of the disclosed fabric over that disclosed in U.S. Pat. No. 4,785,613 supra.

| | Disclosed Fabric | | U.S. Pat. No. 4,785,613 Fabric | |
|---|---|---|---|---|
| Air Permeability | 114.4 | | 274.0 | |
| Lightfastness 60 Hrs. | 5.0 | | 5.0 | |
| Lightfastness 100 Hrs. | 4.5 | | 5.0 | |
| | Warp | Fill | Warp | Fill |
| Tensile @ Break (lb) | 180.4 | 227.2 | 329.3 | 588.7 |
| Elongation @ Break % | 43.3 | 75.9 | 81.7 | 116.7 |
| Elongation @ 5 lb. % | 1.5 | 2.9 | 1.2 | 17.1 |
| Elongation @ 10 lb. % | 2.1 | 7.5 | 1.7 | 24.4 |
| Elongation @ 30 lb. % | 4.3 | 24.2 | 3.5 | 36.4 |
| Elongation @ 50 lb. % | 8.4 | 32.2 | 5.9 | 43.4 |
| Elongation @ 100 lb. % | 18.2 | 46.4 | 13.2 | 53.4 |

As indicated in the above chart, the disclosed fabric has an unexpected air permeability at least 50% lower than that of the U.S. Pat. No. 4,785,613 fabric thereby substantially reducing the amount of dust, etc. exhausted to the atmosphere and at each level of force (5 lb. to 100 lb.) has a lower fill elongation due to the closed stitch construction.

In a modified form of the invention other polyolefin yarns, such as polypropylene, can be used in bar 1 and bar 2 along with the lower elongation HT (high tenacity) polyester yarn on bar 3. In this form of the invention the needle lap stitch yarn in bar 2 will not be textured.

It is obvious that the above described fabric provides substantially lower elongation at low loads so that the grasscatcher bag made therefrom will be sturdier and cheaper but at the same time maintains the warp tensile strength to prevent objects from being thrown through the bag material while maintaining permeability.

Although the preferred embodiment of the invention has been described specifically it is contemplated that many changes may be made without departing from the scope or spirit of the invention and it is desired that the invention be limited only by the scope of the claims.

I claim:

1. Apparatus to mow a lawn comprising: a lawn mower with a discharge outlet and a grasscatcher bag connected to said outlet, said grasscatcher bag being made of a warp knit fabric having a plurality of chain stitches interknit with a plurality of closed multiple needle lap stitches of textured synthetic yarn with adjacent wales connected to one another with a high tenacity yarn having lower elongation characteristics than the other yarns in said fabric to reduce the elasticity of the fabric at low load conditions in the course direction of the fabric.

2. The bag of claim 1 wherein said warp knit fabric is a 3-bar fabric.

3. The bag of claim 2 wherein said lower elongation yarn is knit on one bar in a 0-0, 2-2 pattern.

4. The bag of claim 3 wherein the other two bars are knitting, respectively, in a 4-5, 1-0 and a 1-0, 0-1 pattern.

5. The bag of claim 4 wherein substantially all of said yarns are polyester.

6. The bag of claim 5 wherein the denier of lower elongation yarns is about 150 denier.

7. The bag of claim 6 wherein all of said yarns are polyester.

8. The bag of claim 1 wherein substantially all of said yarns are 150 denier polyester.

9. A grasscatcher bag for a lawn mower comprising: a 3-bar warp knit fabric formed into tubular form with the course direction extending around the diameter of the tube and the wale direction extending longitudinally of the tube, having a plurality of chain stitches interknit with a plurality of closed multiple needle lap stitches of textured synthetic yarn with adjacent wales connected to one another with a high tenacity yarn having lower elongation characteristics than the other yarns in said fabric to reduce the elasticity of the fabric at low lead conditions in the course direction of the fabric.

10. The bag of claim 9 wherein said lower elongation yarn is knit on one bar in a 0-0, 2-2 pattern.

11. The bag of claim 10 wherein the other two bars are knitting, respectively, in a 4-5, 1-0 and an 0-1, 1-0 pattern.

12. The bag of claim 11 wherein substantially all of said yarns are polyester.

13. The bag of claim 12 wherein the denier of lower elongation yarns is about 150 denier.

14. The bag of claim 13 wherein all of said yarns are polyester.

15. The bag of claim 9 wherein substantially all of said yarns are 150 denier polyester.

* * * * *